US011607062B2

(12) United States Patent
Stinchcomb

(10) Patent No.: US 11,607,062 B2
(45) **Date of Patent: *Mar. 21, 2023**

(54) INTEGRATED BEDDING COVER SYSTEM AND METHOD

(71) Applicant: PeeKoo Bedding Concepts, LLC, Lafayette, CO (US)

(72) Inventor: Emily Stinchcomb, Lafayette, CO (US)

(73) Assignee: PEEKOO BEDDING CONCEPTS, LLC, Lafayette, CO (US)

( * ) Notice: Subject to any disclaimer, the term of this patent is extended or adjusted under 35 U.S.C. 154(b) by 353 days.

This patent is subject to a terminal disclaimer.

(21) Appl. No.: 16/895,686

(22) Filed: Jun. 8, 2020

(65) Prior Publication Data

US 2020/0367671 A1 Nov. 26, 2020

Related U.S. Application Data

(60) Continuation of application No. 15/820,847, filed on Nov. 22, 2017, now Pat. No. 10,674,844, which is a (Continued)

(51) Int. Cl.
*A47G 9/04* (2006.01)
*A47G 9/02* (2006.01)

(52) U.S. Cl.
CPC ..... *A47G 9/04* (2013.01); *A47G 9/02* (2013.01); *A47G 2009/0269* (2013.01); *Y10T 29/481* (2015.01); *Y10T 29/49826* (2015.01)

(58) Field of Classification Search
CPC ..... A47G 9/02; A47G 9/0207; A47G 9/0238; A47G 9/0261; A47G 9/04; A47G 2009/0269; Y10T 29/48; Y10T 29/49826
See application file for complete search history.

(56) References Cited

U.S. PATENT DOCUMENTS 2,505,027 A 4/1950 Belsky
2,799,870 A 7/1957 Sullivan
(Continued)

FOREIGN PATENT DOCUMENTS

GB 2385521 A * 8/2003 ..... A47G 9/0261

OTHER PUBLICATIONS

Smart Bedding, "Smart Bedding—Never Make Your Bed Again", obtained online on Nov. 1, 2013 at: http://www.kickstarter.com/projects/marshallhaas/smart-bedding-never-make--your-bed-again, funding period opened on Jul. 15, 2013, 23 pages.
(Continued)

*Primary Examiner* — David R Hare
(74) *Attorney, Agent, or Firm* — Faegre Drinker Biddle & Reath

(57) ABSTRACT

The embodiments described herein generally relate to a system and method for joining a detachable fabric sheet to a cover through the use of one or more corresponding fastening or temporary joining mechanisms located on the cover and fabric sheet. In an embodiment, the cover includes one or more mechanisms to align and/or secure a filling material to the cover, as well as one or more fastening or temporary joining mechanisms for attaching the detachable fabric sheet to the cover. Methods and systems are provided for detachably joining the fabric sheet to the cover, for creating a multi-layer unit of a cover and detachable sheets, as well as for aligning and securing the filler to the cover. A method is also provided for manufacturing the integrated bedding cover system.

16 Claims, 13 Drawing Sheets

Related U.S. Application Data continuation of application No. 14/182,771, filed on Feb. 18, 2014, now Pat. No. 9,826,848, which is a division of application No. 12/612,643, filed on Nov. 4, 2009, now Pat. No. 8,689,375.

(60) Provisional application No. 61/111,259, filed on Nov. 4, 2008.

(56) References Cited

U.S. PATENT DOCUMENTS

| | | | | |
|---|---|---|---|---|
| 2,810,921 | A | 10/1957 | Seidenberg | |
| 2,821,723 | A | 2/1958 | Gluck | |
| 3,083,378 | A * | 4/1963 | Pursell | A47C 21/022 5/413 R |
| 3,178,734 | A | 4/1965 | Daniel | |
| 3,179,958 | A | 4/1965 | Carris | |
| 3,241,161 | A | 3/1966 | Dashosh | |
| 3,801,420 | A | 4/1974 | Anderson | |
| 3,965,504 | A | 6/1976 | Ainsworth | |
| 4,513,461 | A | 4/1985 | Tardivel | |
| 4,903,361 | A | 2/1990 | Tang | |
| D319,366 | S | 8/1991 | Popovich | |
| 5,092,010 | A | 3/1992 | Wong | |
| 5,099,531 | A | 3/1992 | Schmier | |
| 5,157,799 | A | 10/1992 | Aird | |
| 5,321,862 | A | 6/1994 | Campbell | |
| 6,098,219 | A * | 8/2000 | Milber | A47C 21/022 5/494 |
| 6,886,197 | B1 * | 5/2005 | Madigan | A47G 9/02 5/493 |
| 7,111,345 | B1 | 9/2006 | Hui | |
| 7,140,053 | B1 | 11/2006 | Mangano | |
| 7,228,578 | B2 | 6/2007 | Linnane | |
| 7,249,389 | B2 * | 7/2007 | Russell | A47G 9/0261 5/490 |
| D637,857 | S | 5/2011 | Waite | |
| 8,011,038 | B2 | 9/2011 | Balasundharam | |
| 8,646,133 | B2 | 2/2014 | Tepper | |
| 8,689,375 | B2 | 4/2014 | Stinchcomb | |
| 9,826,848 | B2 | 11/2017 | Stinchcomb | |
| 10,674,844 | B2 * | 6/2020 | Stinchcomb | A47G 9/02 |
| 2004/0031098 | A1 | 2/2004 | Hollander | |
| 2004/0187210 | A1 | 9/2004 | Hickman | |
| 2005/0144721 | A1 * | 7/2005 | Linnane | A47G 9/0261 5/501 |
| 2007/0067909 | A1 | 3/2007 | Lampkins | |
| 2007/0226908 | A1 | 10/2007 | Hollander | |
| 2007/0245492 | A1 * | 10/2007 | Combellick | A47G 9/0284 5/482 |
| 2008/0104751 | A1 * | 5/2008 | Friedland | A47G 9/02 5/502 |
| 2009/0126111 | A1 | 5/2009 | Maimone | |
| 2010/0050341 | A1 * | 3/2010 | Tepper | A47G 9/0261 5/501 |
| 2010/0107339 | A1 | 5/2010 | Stinchcomb | |
| 2010/0251482 | A1 | 10/2010 | MacDonald | |
| 2012/0167306 | A1 | 7/2012 | Macdonald | |
| 2014/0157575 | A1 | 6/2014 | Stinchcomb | |

OTHER PUBLICATIONS

Zipit Bedding, "The All-in-One Solution Bedding for Kids", obtained online on Mar. 20, 2013 at: www.zipitbedding.com/Home.html, 2012, 2 pages.

* cited by examiner

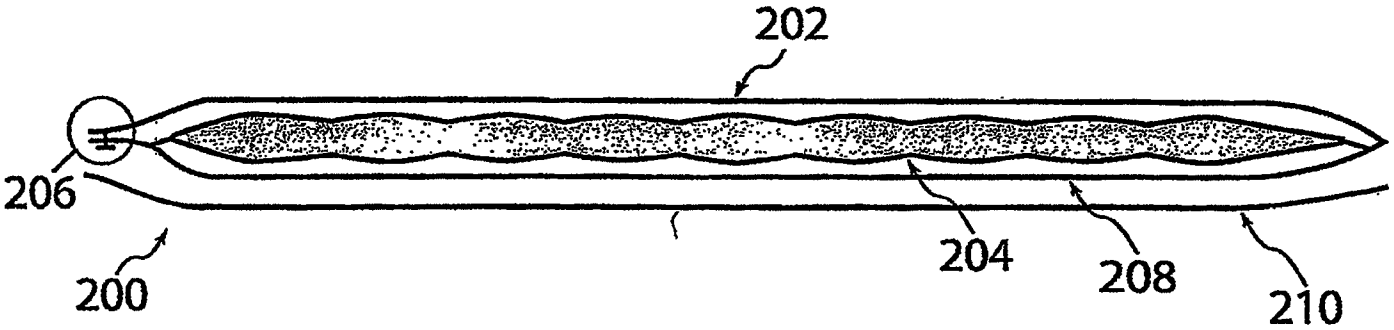
Fig. 2 Side Cross-Section View

INTEGRATED BEDDING COVER SYSTEM AND METHOD

CROSS-REFERENCE TO RELATED APPLICATIONS

This application is a continuation application of U.S. patent application Ser. No. 15/820,847 (now U.S. Pat. No. 10,674,844), filed on Nov. 22, 2017, which application is a continuation application of U.S. patent application Ser. No. 14/182,771 (now U.S. Pat. No. 9,826,848), filed on Feb. 18, 2014, which application is a divisional of U.S. patent application Ser. No. 12/612,643 (now U.S. Pat. No. 8,689,375), filed on Nov. 4, 2009, which application claims the benefit of U.S. Provisional Application Ser. No. 61/111,259, filed on Nov. 4, 2008, and entitled, "INTEGRATED BEDDING COVER SYSTEM AND METHOD." The complete disclosure of each application is hereby incorporated herein by reference in its entirety.

BACKGROUND

Comforters, such as down comforters, provide an extra layer of comfort and warmth to those who choose to use them while sleeping. However, the filler, e.g., down filler, is typically very difficult to clean, and repetitive cleaning can impact the quality of the filler itself. In order to diminish the need for cleaning, fillers are often covered with a duvet or comforter cover. The duvet or comforter cover protects the filler while, at the same time, contributing an aesthetically appealing element to the bed in and of itself.

An alternative to sleeping under a down comforter is sleeping under the top sheet only of a bed setting. While a top sheet is much easier to clean than a duvet or comforter cover, it does not provide the same degree of warmth and comfort as a comforter does. Further, the downside of using a top sheet only as a cover is exacerbated when one considers the desire to create a "neat" looking bed, in which the top sheet must be aligned with the bottom sheet and then tucked into the mattress. Further yet, top sheets tend to shift and get tangled with other bed coverings during sleep, causing discomfort. Many people, especially young children and adolescents, often forego aligning their bed sheets when such task proves too difficult and/or time-consuming.

It is therefore common for people to forego the use of a top sheet and, instead, sleep on a bottom sheet with a cover, e.g., duvet cover, (with filler) only. However, contact between a person's skin and the duvet or comforter cover itself necessitates the cleaning of the duvet or comforter cover more often than a cover that sits only on top of a clean top sheet. Further, to clean the duvet or comforter cover, the filler, e.g., down filler, must be removed from the duvet or comforter cover. The process of removing the filler from the duvet or comforter cover can be difficult and time-consuming. Moreover, re-inserting the filler into the clean duvet or comforter cover can prove quite aggravating as the filler tends to gather or "bunch" unevenly, and it is difficult to manipulate the filler into each corner of the duvet or comforter cover. Indeed, the time consumption and aggravation associated with cleaning a duvet or comforter cover convinces many people to wash their duvet or comforter cover much less often than they should or likely desire to. Alternatively, for those who clean their duvet or comforter covers frequently, these covers fade and become further worn with time.

Although specific problems have been addressed in this Background, this disclosure is not intended in any way to be limited to solving those specific problems.

SUMMARY

Embodiments of the present disclosure generally relate to providing a system and method for creating a bedding cover or cover in general (hereinafter, "cover") with a detachable fabric sheet. Such cover may, for example, include a duvet cover, a comforter cover, a quilt, a blanket, etc. In an embodiment, a filling material, or filler, is inserted into a cover. In a further embodiment, a cover for housing a filler includes a mechanism for easily and securely aligning and fastening the filler into place inside the cover. In a particular embodiment, a fabric sheet is detachably connected, or temporarily joined, to a side, e.g., bottom side, of the cover through the use of a fastening or temporary joining mechanism attached to the cover and a corresponding, e.g., mate, fastening or temporary joining mechanism attached to the fabric sheet. Examples of such fastening or temporary joining mechanisms include a hook-and-eye fastening system and/or interlocking teeth, such as, but not limited to, a zipper. Any number of temporary joining or fastening mechanisms known to those of ordinary skill in the art may be used to join the cover to the fabric sheet in a detachable, or temporary, manner in accordance with embodiments. In an aspect of an embodiment, corresponding fastening mechanisms are attached to the cover and/or fabric sheet in such a manner as to allow the cover to be reversible. In other embodiments, a plurality of fabric sheets, blankets, covers and/or other materials are detachably joined to form a multi-layer unit.

In an embodiment, the detachable fabric sheet comprises a regular bedding sheet, such as a top sheet, with a mechanism, as discussed, for fastening the sheet to the cover in a detachable manner Any number of types of fabric sheets or other materials, e.g., blankets, water-repellant materials such as plastic sheets, etc., known to those of ordinary skill in the art may be used as a detachable sheet.

In a further embodiment, the cover includes within its structure a mechanism to align and secure the filler of the cover with the edges and corners of the cover. In one aspect of an embodiment, such aligning and securing mechanism comprises loops or rings, for example, which are affixed to the cover and attached or available clips, for example, for pulling a portion of a corner of the filler through the loop and fastening it to the loop or ring with the clip. In another aspect of an embodiment, such aligning and securing mechanism comprises ties, or strings, or other pieces of material, affixed to the cover at one or more positions or locations to tie the cover to the filler directly and/or around the loop(s) or ring(s) and/or to loops located on the filler itself, for example. In an embodiment, these loops, clips, and/or ties, for example, may be accessed through pockets or flaps located at each corner or side of the cover to allow a user to "reach" into the cover and pull the filler towards the pocket end for aligning and/or fastening into place.

This Summary is provided to introduce a selection of concepts in a simplified form that is further described below in the Detailed Description. This Summary is not intended to identify key or essential features of the claimed subject matter, nor is it intended to be used in any way as to limit the scope of the claimed subject matter.

BRIEF DESCRIPTION OF THE DRAWINGS

FIG. 2 illustrates an exemplary side cross-section of the exemplary bedding system shown in FIG. 1A in accordance with an embodiment of the present disclosure.

DETAILED DESCRIPTION

Figure 1A:
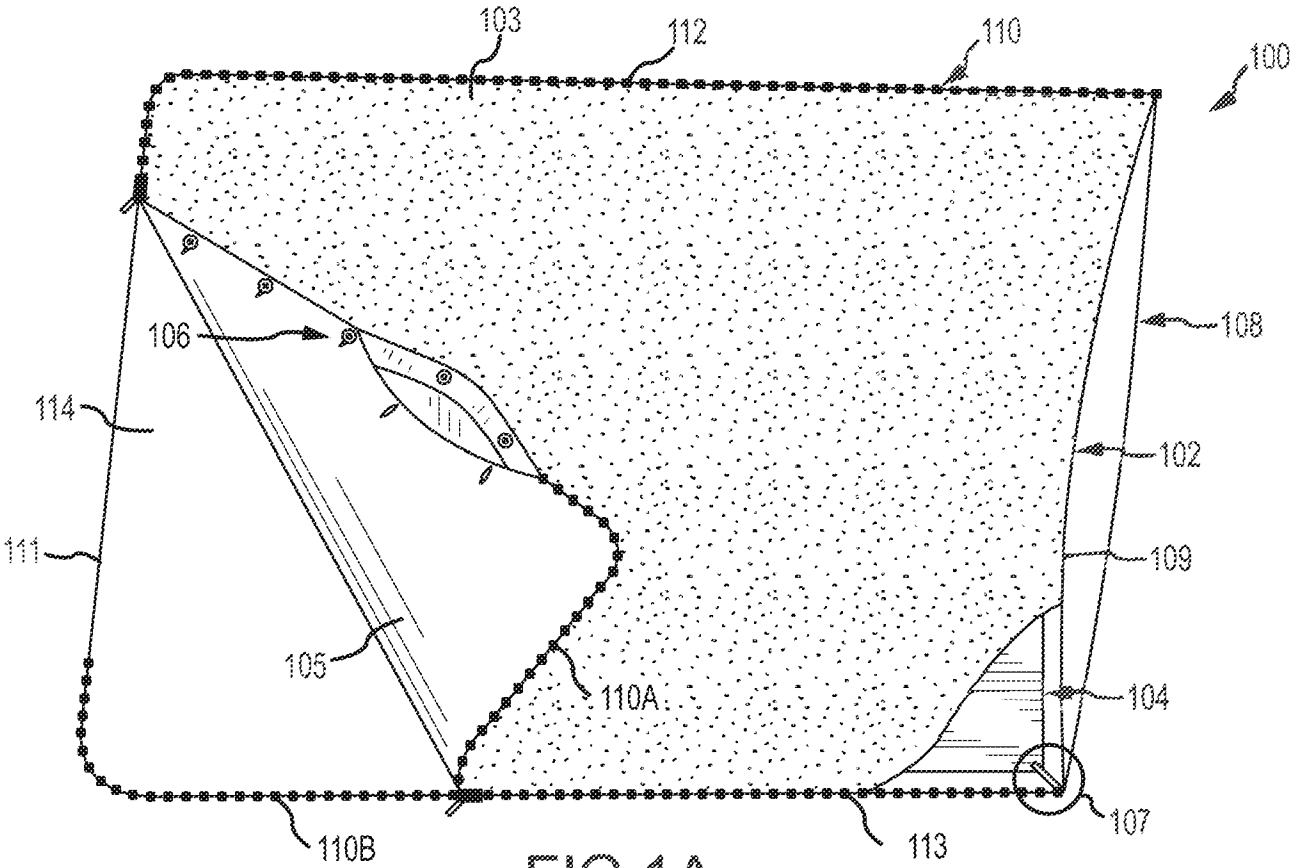
FIG. 1A illustrates an exemplary bedding system including a cover with a fastening mechanism for detachably connecting a fabric sheet to the cover and a securing and aligning mechanism for aligning/securing the cover filler in accordance with an embodiment of the present disclosure.

This disclosure will now more fully describe exemplary embodiments with reference to the accompanying drawings, in which specific embodiments are shown. Other aspects may, however, be embodied in many different forms and the inclusion of specific embodiments in this disclosure should not be construed as limiting such aspects to the embodiments set forth herein. Rather, the embodiments depicted in the drawings are included to provide a disclosure that is thorough and complete and which fully conveys the intended scope to those skilled in the art. Dashed lines may be used to show optional components or operations.

Embodiments of the present disclosure generally relate to providing an integrated bedding cover system and method. In an embodiment, this bedding cover system provides for a cover comprising a fastening or temporary joining mechanism for securing a fabric sheet to the cover such that the fabric sheet is secured to the cover in a detachable manner. The cover houses a cavity (e.g, void, empty space, etc.), in which a filling material, or filler, may be inserted, aligned, and/or adjusted. The cover thus houses or envelops the filler in embodiments. Thus, in an aspect of an embodiment, the bedding cover system provides one or more mechanisms for aligning and securing the filler for the cover. These aligning/securing mechanisms are attached to the cover comprising the fastening mechanism for joining with the detachable sheet.

In an embodiment, the cover comprises one or more fastening or temporary joining mechanisms extending the perimeter, or outside boundary, or portion thereof, of the cover. In an embodiment, the cover comprises a seam which joins the cover panels, or pieces, together and extends the whole perimeter of the cover. In an aspect of an embodiment, the seam extends a portion of the perimeter of the cover. In yet another embodiment, the fastening or temporary joining mechanism may be secured to the cover in such a way, e.g., under the seam of the cover, so as to hide the fastening or temporary joining mechanism. In an embodiment, a portion of material at the seam, for example, is extended to cover the fastening mechanism so as to hide it. Such material acts as a flap over the mechanism in accordance with an embodiment. The material folds over, or envelops, the fastening mechanism and is secured on the other side so as to hide the fastening mechanism from view while still allowing access to it. Or, in another embodiment, the fastening or temporary joining mechanism is secured a defined distance from the seam and is visible, i.e., not hidden by a seam. Such fastening or temporary joining mechanism may be sewn onto the cover, for example, a defined distance from the seam. In another embodiment, the fastening or temporary joining mechanism is secured to the cover on top of the seam joining the cover panels, or pieces, together. In such an embodiment, the fastening or temporary joining mechanism is thus located outside of the seam of the cover. In another embodiment, the fastening or temporary joining mechanism is incorporated into the seam of the cover. Thus, the zipper, for example, is sewn into the seam, or otherwise secured to the seam, of the cover in such an embodiment. The seam of the cover typically extends the entire perimeter of the cover. Where a fastening or temporary joining mechanism, e.g., a zipper, is incorporated into the seam of the cover, it may be incorporated into the entire seam, e.g., extending the whole perimeter, of the cover, (see, e.g., FIG. 1D), or into only a portion of the seam of the cover (see, e.g., FIGS. 1A, 1E and 1F). In another embodiment, the seam does not extend the entire perimeter but, instead, runs a portion of the perimeter.

In another aspect of an embodiment, the fastening or temporary joining mechanism, a zipper, for example, is used itself to join the pieces or panels of fabric comprising the cover, e.g., the top side, bottom side, etc., together. In such an embodiment, the zipper thus acts both to join the panels of fabric and to serve as a mechanism for fastening the detachable fabric sheet to the cover. However, any number of ways of securing the fastening or temporary joining mechanism known to those of ordinary skill in the art may be used. As noted, the one or more fastening or temporary joining mechanism extends the entire perimeter of the cover according to one embodiment of the present disclosure (see, e.g., FIG. 1D). In another embodiment, the fastening or temporary joining mechanisms extend three-quarters (¾) of the perimeter, leaving the end to be placed near the user's face/head open to resemble a typical sheet and cover. In yet another embodiment, the fastening or temporary joining mechanism extends on only two sides or one side and/or two ends or one end of the cover. The fastening or temporary joining mechanism is thus located at one or more positions on the cover in accordance with embodiments.

In an aspect of another embodiment, the fastening or temporary joining mechanisms are secured to the cover such that the cover may be reversed and still be able to detachably join with the fabric sheet. Such feature provides versatility and changeability to the entire bedding cover system. In an aspect of an embodiment allowing for the reversibility of the cover, the fastening or temporary joining mechanism(s) is hidden by covering each side, or part, of the mechanism, e.g., the zipper with pieces of material, e.g., flaps, located at the edge or at the seam itself. The fastening or temporary joining mechanism(s) allowing for reversibility of the cover is secured to the cover under the seam of the cover, for example, to hide the mechanism(s). In an aspect of an embodiment, a portion of material at the seam, for example, is extended to cover the fastening mechanism(s) so as to hide it. Such material acts as a flap over the mechanism(s) in accordance with an embodiment. The material folds over, or envelops, the fastening mechanism(s) and is secured on a side so as to hide the fastening mechanism(s) from view.

A mate, or corresponding second fastening or temporary joining mechanism, is then secured around the matching or corresponding perimeter of a fabric sheet such that the fabric sheet may be attached to the cover by detachably joining the fabric sheet and the cover through operation of the one or more fastening mechanisms. In an embodiment, the fastening or temporary joining mechanism secured to the fabric sheet is referred to as a second fastening or temporary joining mechanism, and the mechanism attached to the cover is referred to as a first fastening or temporary joining mechanism. These first and second mechanisms are "mates" to each other and may be coupled, joined, interlocked, etc. to join the fabric sheet and cover together and allow for detaching the same. For example, such fastening or temporary joining mechanisms may include two corresponding zipper parts comprising a zipper, with teeth mates, e.g., interlocking teeth, with one part located on the cover and the corresponding part located on the fabric sheet. The first fastening or temporary joining mechanism, e.g., first zipper part, may be considered the male connecting part; the second fastening or temporary joining mechanism, e.g., second zipper part, may be considered the female connecting part or vice versa, for example A mechanism, e.g., zipper, thus temporarily joins the edges of the fabric sheet and the corresponding edges of the cover, in accordance with embodiments. Examples of zipper types which may be used, but are not limited to, include coil zippers, invisible zippers, metallic zippers, plastic-molded zippers, open-ended zippers, and closed-ended zippers. These types of zippers are offered by way of example only. Other fastening or temporary joining mechanisms (and mates) may include buttons (and button holes); hooks (and loops), e.g., Velcro® fasteners; and snap fasteners or other interlocking discs, press studs, and/or poppers. These fastening mechanisms are offered by way of example only. Any number of fastening or temporary joining mechanisms known to those of ordinary skill in the art may be used.

In an embodiment, the fabric sheet which is temporarily attachable to, or able to detachably join with, the cover is a regular "top sheet" for use on a bed with at least one fastening or temporary mechanism secured thereto. Examples of materials for the fabric sheet include, but are not limited to, cotton; cotton flannel; wicking material to wick away sweat/wetness; terry; combed cotton; wool; etc. The fabric sheet may also be a blanket, for example. Any number of types of materials may be used for the fabric sheet(s) as reasonably understood by those of reasonable skill in the art in accordance with embodiments of the present disclosure.

In another embodiment, the cover may be attached through the one or more fastening or temporary joining mechanisms to a blanket and a fabric sheet combo. In such an embodiment, the cover is attached to the blanket which is then attached to the fabric sheet. In an aspect of an embodiment, multiple fastening or temporary joining mechanisms are used such that multiple layers of blankets and/or sheets may be attached to each other to create a warmer, multi-layer effect. In such an embodiment, a first fastening mechanism is attached to the bottom side of the cover. A second fastening mechanism is secured to the top side of a first fabric sheet, e.g., a blanket. A third fastening mechanism may then be attached to the bottom side of the first fabric sheet, and a fourth fastening mechanism may then be attached to the top side of a second fabric sheet. The first and second fastening mechanisms may then be coupled with each other to temporarily join the cover and the first fabric sheet to each other. The second and third fastening mechanisms may then also be coupled with each other to detachably join the first fabric sheet and the second fabric sheet together. The resulting multi-layer unit thus comprises a cover, first fabric sheet, and a second fabric sheet joined as one multi-layer unit in accordance with embodiments. Any number and types of layers of sheets and covers may be detachably joined in this manner to create a multi-layer effect in accordance with embodiments and as reasonably understood by those of ordinary skill in the art.

Further, in an embodiment, the bedding cover system also comprises one or more mechanisms to align and secure the filler housed, or enveloped by, the cover. The cover comprises one or more open sides and/or ends in an embodiment, in which buttons and button holes are used to close the opening once the filler for the cover is placed therein. Fastening mechanisms other than buttons and button holes may be used. Any number of fastening mechanisms known to those of ordinary skill in the art may be used.

In an aspect of an embodiment, at an open end of the cover, a loop is secured to each corner of the cover at the open end. A clip, such as a plastic clip, is affixed to this loop. When the user "stuffs" the filler into the cover, the user may affix the appropriate open corner of the filler to the appropriate corner of the cover by pulling a portion of the filler through the loop and attaching the clip through the loop and over the filler to secure it into place. Such loop-and-clip system and method may also be used at the other corner of the open end. In an aspect of another embodiment, loops and clips are used at each corner of the cover and are accessed through the one open end. In other embodiments, the cover comprises open ends on all four sides (with fastening mechanism(s) to close these ends). Loops and clips are affixed to each corner in such an embodiment. In an alternative embodiment, clips may be made available for such use. While this description discusses the use of "clips," any number of fastening means may be used as known to those of ordinary skill in the art. "Clips" and "loops" are offered by way of example only. For example, a ring may be affixed to each corner according to another embodiment. Such ring may be circular in shape in one aspect of an embodiment, or, alternatively, may have any shape that allows a portion of the filler to pass through the ring. Further, other securing mechanisms may be used. For example, magnets may be sewn into the opposite corners of the cover to secure a filler placed between the magnet mates. In such an embodiment, a magnet and its mate may be hidden from view by attaching them to the corresponding pieces of fabric and covering them with the fabric so as to envelop each magnet in a cavity. One magnet is attached to the top side of the cover, and the magnet's mate is attached to the bottom side of the corner, for example, in such a manner so that the magnets are lined up with each other and will make contact with each other to hold the filler in place.

In another embodiment, pockets are located in the cover. In an embodiment, these pockets are located at one or more corners of the cover. In another embodiment, these pockets are located on one or more sides and/or one or more ends of the cover. In an aspect of an embodiment, these pockets are cut into the cover by cutting the top side, or bottom side in another embodiment, of the cover at an angle, e.g., a forty-five degree angle, so as to create a flap providing an opening into the cover cavity. Other angle degrees may be used. A "forty-five" degree angle is offered as an example. These pockets may be opened to allow a user to reach the filler and pull it toward the corner end of the cover to properly align it and "smooth" it in the cover using an alignment/securing mechanism such as the loop-and-clip system discussed above. Once this alignment occurs, the pocket may be closed by fastening it through some fastening mechanism, such as, for example, through the use of a button and matching button hole, Velcro®, snap fasteners, magnets, or any other type of fastening mechanisms known to those of ordinary skill in the art.

A top view of a bedding cover system 100 for joining a fabric sheet in a detachable manner to one surface of a cover through the use of one or more fastening or temporary joining mechanisms located on the perimeter of the cover with corresponding one or more fastening or temporary joining mechanisms secured on a fabric sheet is shown in FIGS. 1A, 1D, 1E and 1F, in accordance with an embodiment of the present disclosure. FIGS. 1A, 1D, 1E and 1F depict a top view of cover 102, in which cover 102 comprises top surface, or top side, 103, bottom side 105, first end 109, second end 111, first side 112, and second side 113. "Surface' and "side" are used interchangeably in this description and have the same meaning. By securing the one or more sides and/or one or more ends to each other, a cavity (e.g., void, empty space, etc.) is formed between the sides and ends for accepting a filling material 104 which may be inserted into the cavity. The sides and ends depicted in FIGS. 1A, 1D, 1E and 1F thus house a cavity or void or empty space (shown as being filled with filler 104 in FIGS. 1A, 1D, 1E and 1F). In an embodiment, the edges of the one or more sides and/or one or more ends are secured to each other so as to create the cavity which the cover houses. In other embodiments, the one or more sides and/or one or more ends are secured at a location other than the edges of the one or more sides and/or one or more ends to make a cavity. As noted, the cavity in FIGS. 1A, 1D, 1E and 1F, is depicted as being filled by filler 104. The cover 102 thus envelops filler 104.

Figure 1B:
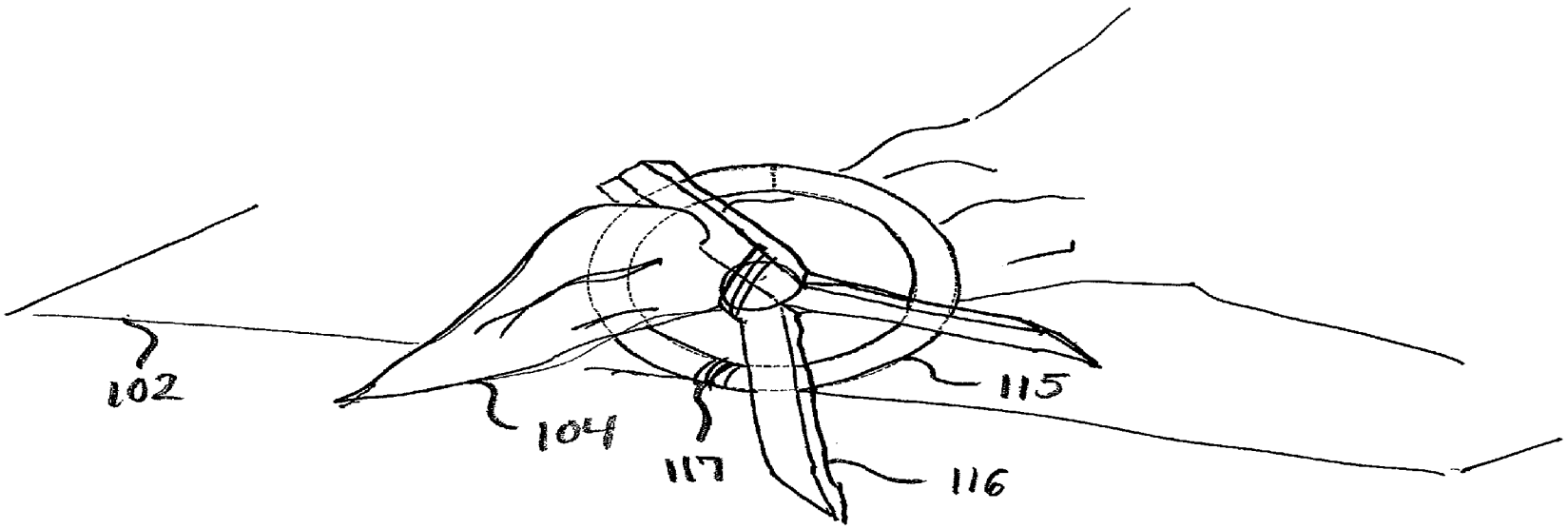
FIG. 1B shows a loop affixed to the cover shown in FIG. 1A and a clip for aligning and securing the filler to the cover.

In a particular embodiment, cover 102 comprises a fastening or temporary joining mechanism 110 secured to the perimeter, or portion thereof, of cover 102. While FIGS. 1A, 1D, 1E and 1F depict the fastening or temporary joining mechanism 110 as a zipper, any number of types of fastening or temporary joining mechanisms known to those of ordinary skill in the art may be used. It is to be understood that mechanism 110 comprises a first fastening or temporary joining mechanism 110A and a second fastening or temporary joining mechanism 110B which couple, mate, or detachably connect/join with each other to form the combined fastening or temporary joining mechanism 110 depicted on the first side 112 in FIGS. 1A, 1D, 1E and 1F. Further, FIGS. 1A, 1D, 1E and 1F depict the fastening or temporary joining mechanism 110 as a closed zipper on first side 112 that has joined the cover 102 with the detachable fabric sheet 108 by "mating" the first mechanism 110A and second mechanism 110B with each other. Second side 113 then shows a partially open, or not joined, fastening or temporary joining mechanism in which the first fastening or temporary joining mechanism 110A attached to cover 102 is detached from the corresponding, e.g., mating, second fastening or temporary joining mechanism 110B. Two separate zippers are shown in FIG. 1A (with one zipper shown on first side 112 and a second zipper shown on second side 113). Each zipper 110 comprises a first fastening or temporary joining mechanism 110A and a second fastening or temporary joining mechanism 110B to mate together to close each zipper. It is to be understood that any number of fastening or temporary joining mechanisms may be used without departing from the spirit and scope of the present invention. For example, FIG. 1D shows a single zipper extending along first end 109, first side 112, second end 111, and second side 113. FIG. 1E shows two separate zippers (with one zipper shown on first side 112, a portion of first end 109 and a portion of second end 111, and a second zipper shown on second side 113, a portion of first end 109 and a portion of second end 111). FIG. 1F shows a single zipper extending along first end 109, first side 112, second side 113, and a portion of second end 111.

In an embodiment, a first fastening or temporary joining mechanism 110A is attached to the edge of cover 102 and a second fastening or temporary joining mechanism 110B is secured to the edge of fabric sheet 108. Together, these first and second mechanisms comprise closed zipper 110 shown in FIG. 1A as an exemplary embodiment.

In another embodiment, the first fastening or temporary joining mechanism 110A comprising mechanism 110 is secured to the bottom side 105 of cover 102 and located a defined distance from the edge of the bottom side 105. In another embodiment, the fastening or temporary joining mechanism 110A is secured to the top side 103 of cover 102 and located a defined distance from the edge of the top side. The second fastening or temporary joining mechanism 110B comprising mechanism 110 is secured to the top side 114 of fabric sheet 108 and is located a corresponding defined distance, e.g., at a distance corresponding to the position of the mate mechanism located on the cover 102, from the edge of fabric sheet 108. In such an embodiment, the second fastening mechanism is secured to a portion of a perimeter of the top side 114 of the fabric sheet corresponding to the portion of the perimeter of the bottom side 105 (or top side 103 according to other embodiments) of the cover 102 to which the first fastening mechanism 110A is secured. The second fastening mechanism 110B corresponds, e.g., is a "mate," to the first fastening mechanism 110A to detachably connect the bottom side of the cover 105 and the top side 114 of the fabric sheet 108 using the first and second fastening mechanisms. In another embodiment, the second fastening or temporary joining mechanism 110B is secured to the bottom side (not shown) of fabric sheet 108.

Figure 1C:
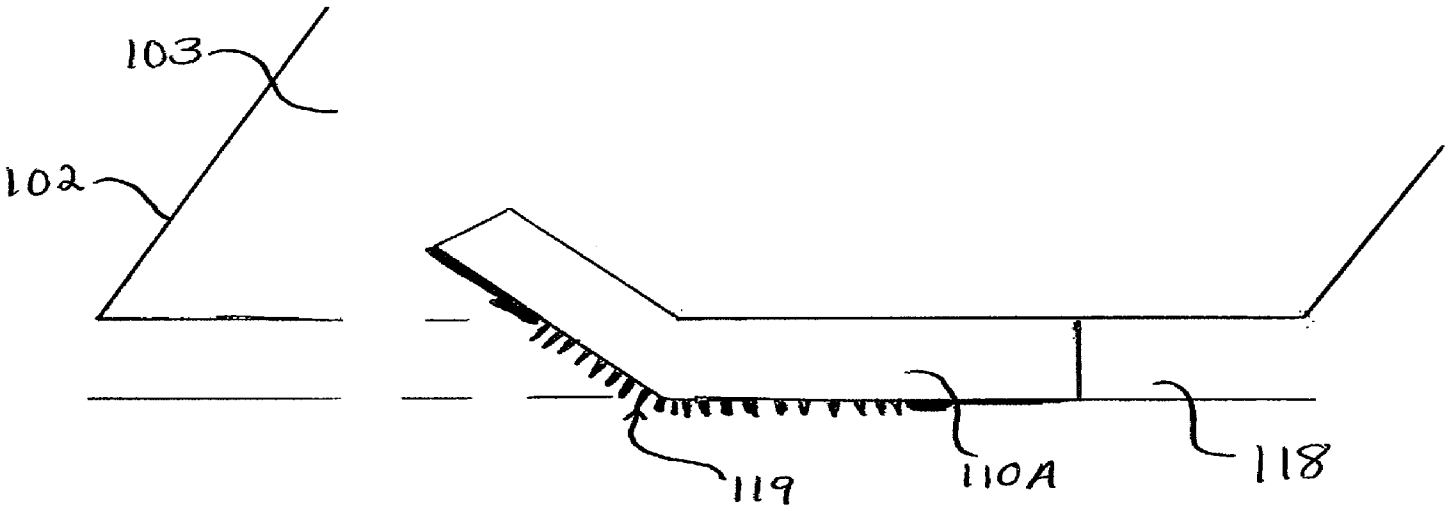
FIG. 1C depicts a first fastening or temporary joining mechanism, e.g., a first zipper part, incorporated into the seam of the cover shown in FIG. 1A.
Figure 1D:
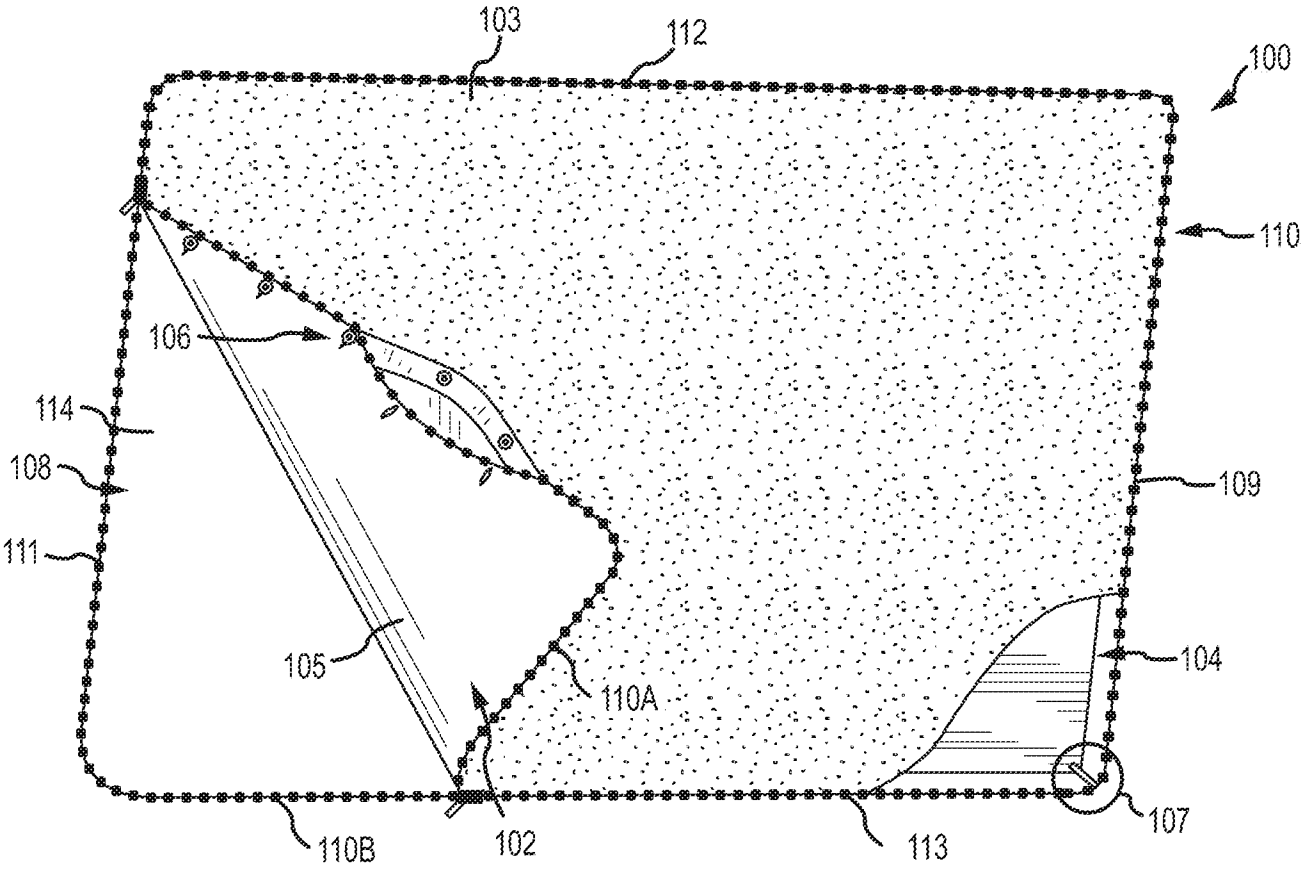
FIG. 1D depicts a first fastening or temporary joining mechanism, e.g., a first zipper part, incorporated into the entire seam, e.g., extending the whole perimeter, of the cover shown in FIG. 1A.
Figure 1E:
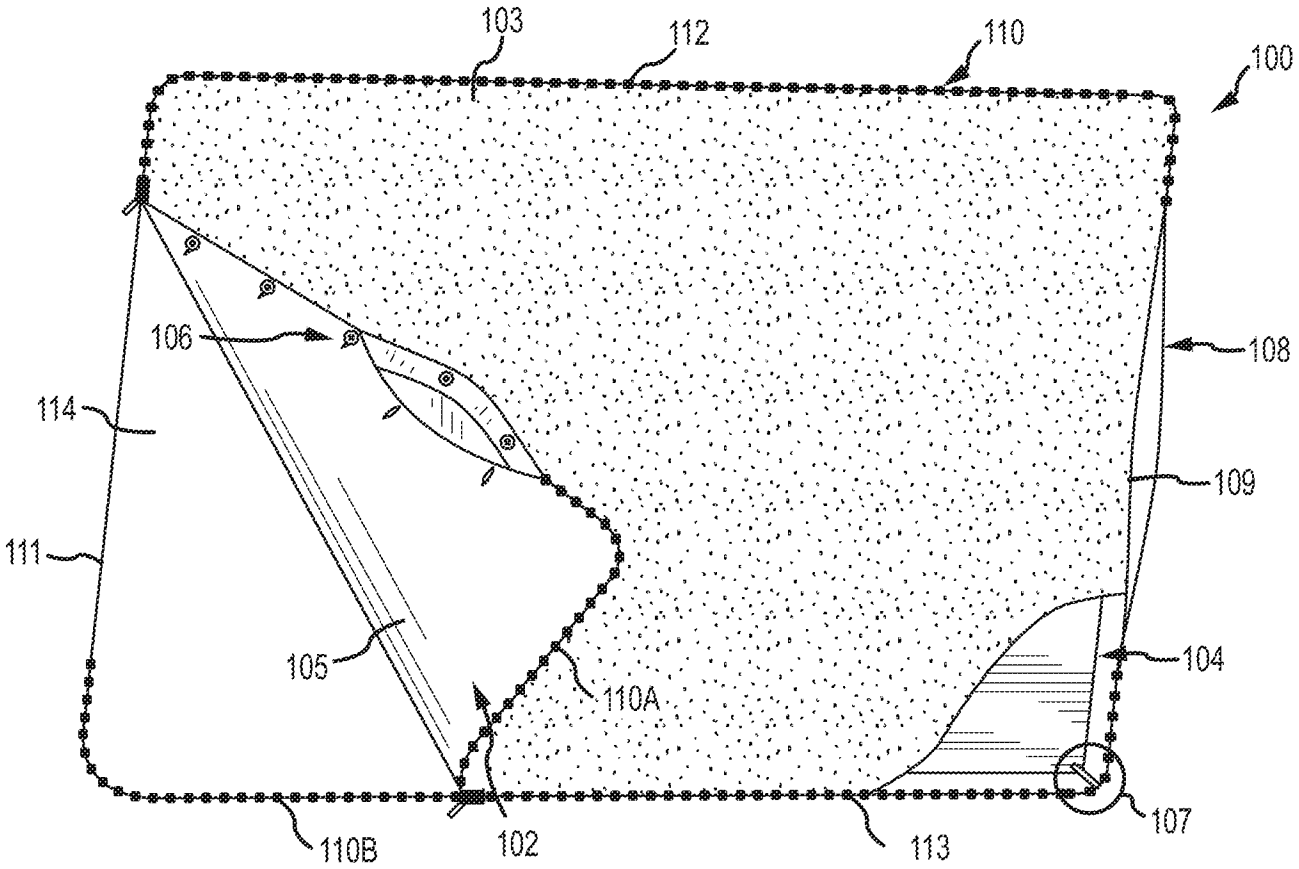
FIG. 1E depicts a first fastening or temporary joining mechanism, e.g., a first zipper part, incorporated into a portion of the seam of the cover shown in FIG. 1A.
Figure 1F:
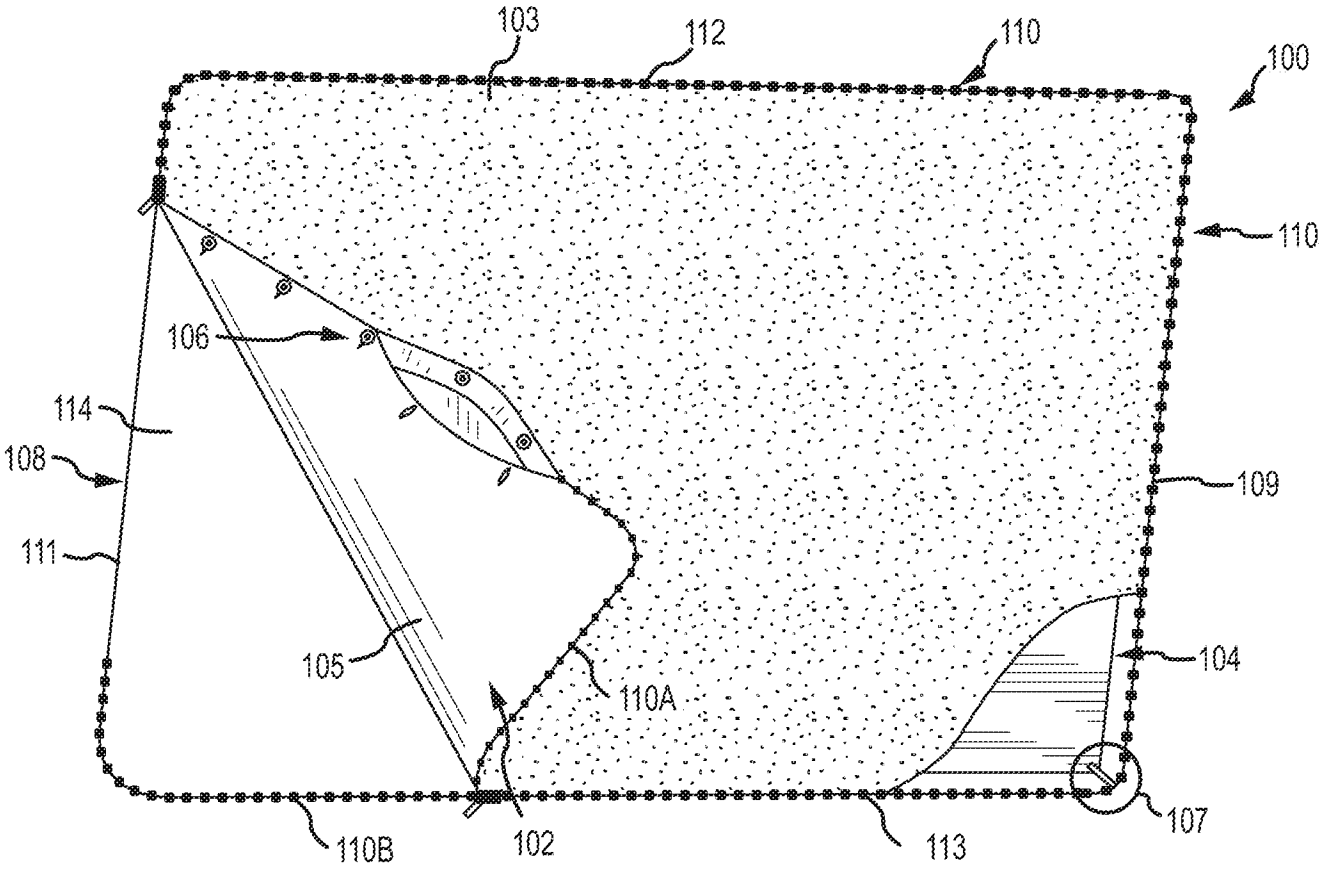
FIG. 1F depicts a first fastening or temporary joining mechanism, e.g., a first zipper part, incorporated into a portion of the seam of the cover shown in FIG. 1A.

In yet another embodiment depicted in detail in FIG. 1C, fastening or temporary joining mechanism 110A is incorporated into seam 118 joining the sides (and/or ends in another embodiment) of cover 102 together, such as joining top side 103 of cover 102 with the bottom side 105 of cover 102. Fastening or temporary joining mechanism 110A is shown as a zipper with teeth 119 in FIG. 1C. As noted, a zipper is offered only as an example of a type of fastening or temporary joining mechanism that may be used in embodiments of the present disclosure. In an embodiment, seam 118 extends the first side 112, second side 113, first end 109 and second end 111 of cover 102 in accordance with an embodiment. In another embodiment, seam 118 extends only a portion of cover 102. In an aspect of an embodiment, the fastening or temporary joining mechanism is incorporated into cover 102 by sewing the mechanism 110A, e.g., the portion of the mechanism to be secured to cover 102 that corresponds to the mating portion of the mechanism 110B to be secured to fabric sheet 108, into the seam. For example, a hidden zipper may be sewn into a straight seam of the cover 102 according to an embodiment by sewing one or more stitches, such as basting stitches, in the seam, opening the seam, pinning first fastening or temporary joining mechanism 110A to the fabric, and stitching, e.g., straight stitching, and/or back-stitching to secure the mechanism 110A, e.g., portion of zipper, in place. Any number of ways of incorporating a fastening or temporary securing mechanism known to those of ordinary skill in the art may be understood by a person of ordinary skill in the art in accordance with embodiments of the present disclosure. Sewing/stitching to incorporate the zipper into the seam is offered by way of example only. In another embodiment, the fastening or temporary joining mechanism is incorporated into the seam of cover 102 by using glue or another type of adhesive reasonably known to those of ordinary skill in the art. In embodiments, the incorporation of the fastening or temporary joining mechanism occurs with an already-made cover. In another embodiment, the incorporation occurs at the time of making the cover.

As discussed, the second fastening or temporary joining mechanism 110B thus corresponds or mates/couples with the first fastening or temporary joining mechanism 110A to detachably connect the cover 102 with the fabric sheet 108. For example, the second fastening or temporarily joining mechanism 110B is the mate, corresponding part, to the first fastening mechanism, in which the male connecting part of the mechanism 110A is located at a position on the cover 102, and the female connecting part of the mechanism 110B is located at a corresponding position on the fabric sheet 108 according to an embodiment of the disclosure. Where, for example, a zipper is used, the first fastening or temporary joining mechanism 110A comprises a first set of interlocking teeth, and the second fastening or temporary joining mechanism 110B comprises the corresponding set of interlocking teeth which mate or couple with the first set of teeth to bring together the two sides, or sets, of interlocking teeth to close the zipper 110.

While bedding cover system 100 depicts two separate zippers 110, for example, in another embodiment, one zipper covers the same portion of the cover. In yet other embodiments, one zipper covers a smaller or greater portion of the cover. In a further embodiment, multiple zippers (more than two) are used to cover defined portions of the perimeter. Further, as discussed below, any number of types of fastening or temporary joining mechanisms known to those of ordinary skill in the art may be used.

As shown in FIG. 1A, the cover 102 includes filler, or filling material, 104 inside of it. In an embodiment, such filler 104 is placed in the open end(s) of cover 102, and then the cover opening is closed through the use of one or more fastening or temporary joining mechanisms, such as buttons and button holes 106 depicted in FIG. 1A. In the embodiment depicted in FIG. 1A, the second end 111 is shown as the open end with buttons and button holes 106 for temporarily closing the end once the filler has been placed in the cavity of cover 102 and/or any adjustments to the filler and/or cavity have been made. In another embodiment, first end 109, first side 112, or second side 113 is the open portion of cover 102. In another aspect of an embodiment, first end 109, second end 111, first side 112, and second side 113 are all open, or, in another embodiment, are all closed, whether temporarily or permanently. Further, in another embodiment, a side(s) or end(s) that is open does not include any fastening mechanism such that the side(s) or end(s) always stays open.

According to another embodiment, the filler 104 is aligned and secured/attached to the cover 102 through the use of an alignment/securing system 107. In an embodiment, such alignment/securing system 107 comprises one or more pieces of material secured, e.g., sewn into, the cover to tie to the filler 104 to align and secure the filler 104 in place. For example, such pieces of material, e.g., ties or strings, may tie filler 104 to loops, for example, located on the filler 104. Such pieces of material for securing the filler 104 in place are located at a corner(s) of the cover, at all corners of the cover, at a middle section of the cover, at an end of the cover, etc. Any number of such pieces of material may be used. Further, "ties" and "strings" are offered by way of example only. Any securing mechanism, e.g., clamp, clip, etc., reasonably known to those of ordinary skill in the art may be used in accordance with embodiments of the present disclosure.

Further, in another embodiment shown in FIG. 1B, the filler 104 is straightened/aligned by pulling it through a ring or loop 115 affixed to the cover. FIG. 1B depicts an exemplary embodiment of alignment/securing system 107, in which loop 115 is shown as being affixed 117 to cover 102. Filler 104 has been pulled through loop 115 and has been secured to loop 115 using clip 116. It is to be understood that any type of aligning/securing system may be used as reasonably understood by those of ordinary skill in the art. For example, a cloth ring, plastic ring, or any other entity creating a void of any shape through which material may be pulled through may be used. Further, while clip 116 is shown in FIG. 1B, any type of securing mechanism may be used, such as a plastic clip, a wood clip, a clothespin, a ribbon, a tie, a string, etc.

While FIG. 1A illustrates a top view of the bedding cover system, FIG. 2 depicts a cross-section view 200 of the bedding cover system in accordance with an embodiment of the present disclosure. As shown in FIG. 2, cover 202 (corresponding to cover 102 in FIG. 1A) houses a filler, or filling material, 204 (corresponding to filler 104 in FIG. 1A). This filler 204 is closed within cover 202 through the use of a fastening or temporary joining mechanism 206 (corresponding to buttons/button holes 106 in FIG. 1A), such as buttons/button holes. The fabric sheet 208 (corresponding to fabric sheet 108 in FIG. 1A) is then attached to the cover 202. The combined bedding system comprising the cover 202, the filler 204 inserted into and secured to (in embodiments) the cover 202, and the fabric sheet 208 lay as a unit on top of the bottom, or fitted sheet, 210 enclosing a mattress, foam, cushion, or other filling material. The entire system may be any size known to those of ordinary skill in the art, including, but not limited to, twin, double, full, queen, king, California king, and extra-long twin sizes. Further, custom sizes and shapes may also be used. The entire system may also be used on a crib or other child's bed according to an embodiment of the present disclosure. In accordance with another embodiment, the entire system may be used on a pet's bed or pet's cushion to provide a way to easily and frequently launder the pet's bed or cushion without damaging the filler used in such bed or cushion.

Figure 3:
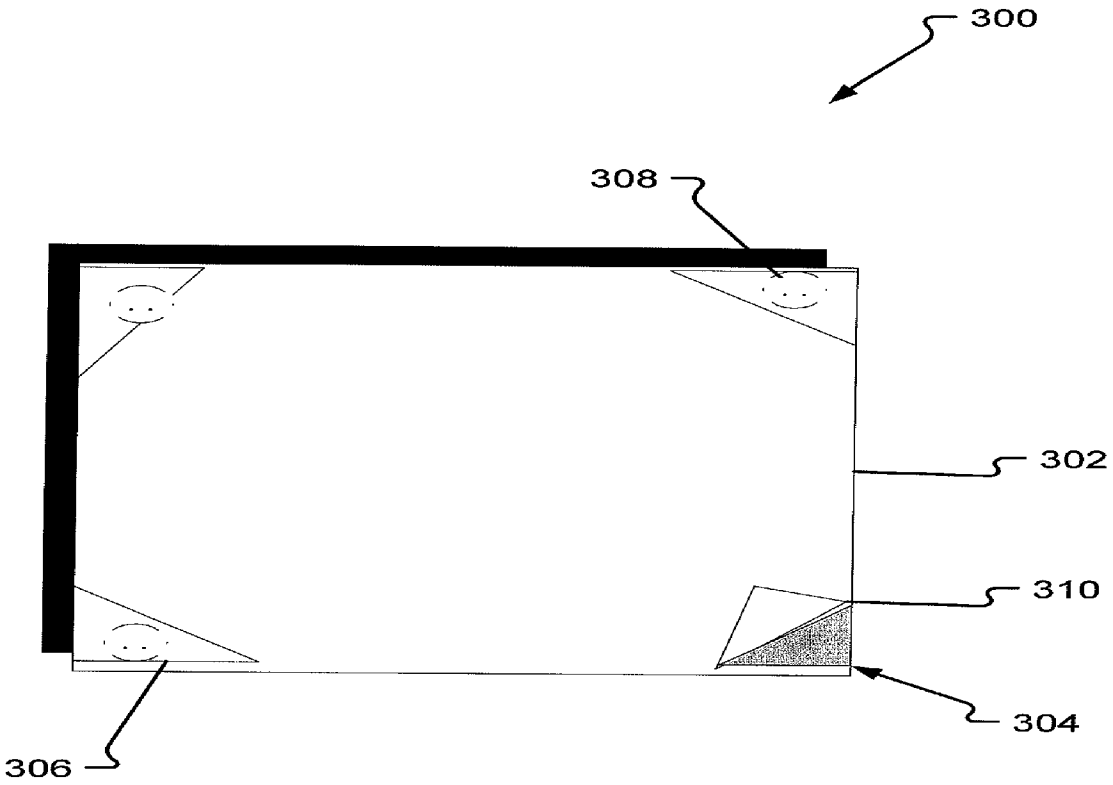
FIG. 3 depicts an exemplary pocket corner system for aligning and securing the cover filler to the cover illustrated in FIGS. 1A and 2 in accordance with an embodiment of the present disclosure.

Turning to FIG. 3, while FIG. 1B illustrates an alignment/securing system 107 system for aligning and attaching/securing the filler 104 to the cover 102 in accordance with an embodiment of the disclosure, FIG. 3 depicts pockets or flaps 306 for reaching into the cover 302 and pulling the filler 304 to align and/or secure it in the cover 302 in accordance with another embodiment of the present disclosure. The pockets 306 are closed, or fastened, through the use of buttons and matching button holes 308, for example, or any other fastening or temporarily joining mechanism(s) known to those of ordinary skill in the art. An opened pocket 310 is shown with the exposed filler 304. One or more fastening or temporary joining mechanisms, e.g., a zipper, (not shown) extend the perimeter, or portion thereof, of the cover 302, as depicted in FIG. 1A (e.g., zippers 110).

Figure 4:
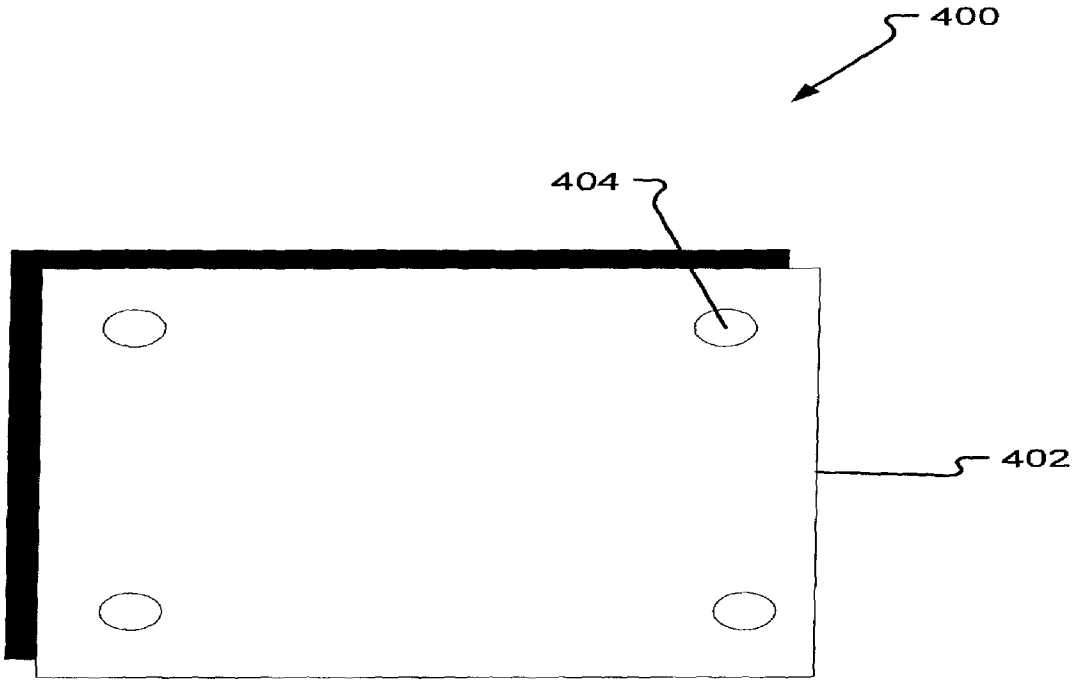
FIG. 4 shows an exemplary system for using a fastening mechanism to align and secure the filler for the cover to the cover in accordance with an embodiment of the present disclosure.

Further, FIG. 4 depicts the use of securing/aligning mechanisms other than the use of pockets illustrated in FIG. 3 in accordance with an embodiment of the present disclosure. Magnets 404, for example, may be sewn into each corner of the cover 402 (corresponding to cover 102 in FIG. 1A) to hold the filler (not shown) in place in accordance with an aspect of an embodiment. While FIG. 4 shows the magnets located in the corners of cover 402, in which one magnet mate is located on the top side of cover 402 and the other magnet mate (not shown) is located on the bottom side of cover 402, in other embodiments, magnets are located at any position(s) or location(s) of cover 402 without departing from the spirit and scope of the disclosure. As discussed above, any number of securing/aligning mechanisms known to those of ordinary skill in the art may be used.

Figure 5:
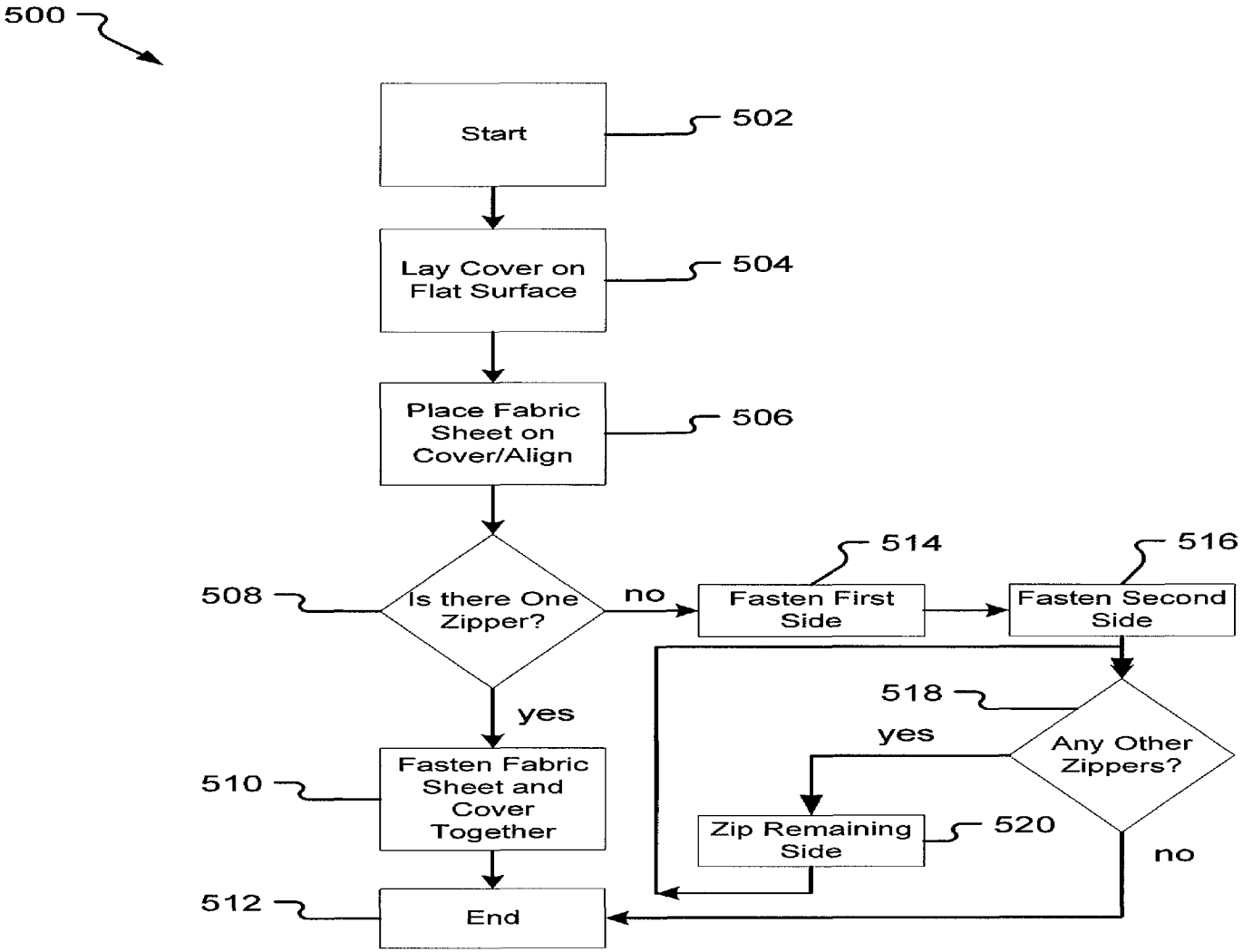
FIG. 5 depicts a flow diagram illustrating the operational characteristics of a process for joining the cover to the fabric sheet in a detachable manner in accordance with an embodiment of the present disclosure.

While FIGS. 1-4 show the bedding cover system at different views and with specific features in accordance with embodiments of the present disclosure, FIG. 5 depicts the operational steps 500 for joining a detachable fabric sheet to a top or bottom surface of a cover system, in accordance with an embodiment of the present disclosure. Start operation 502 is initiated and process 500 proceeds to operation 504 in which the cover is laid on top of a flat surface. The cover may be laid on any type of service. "Flat" is offered as an example type of surface only. Process 500 continues to place and align operation 506 in which the detachable fabric sheet is aligned with the cover so as to align the first fastening or temporary joining mechanism secured to the cover and corresponding second fastening or temporary joining mechanism secured to the fabric sheet so that they may be joined together in a detachable manner Upon aligning the cover and the fabric sheet, query step 508 determines whether there is one zipper or multiple zippers. While this description provides for the use of a single zipper or multiple zippers, a zipper is used as an exemplary fastening/temporary joining mechanism. As discussed above, any type of fastening or temporary joining mechanism may be used as known to those of ordinary skill in the art without departing from the spirit and scope of the disclosure. If there is only one zipper, process 500 proceeds YES to fasten fabric sheet and cover together operation 510, in which the fabric sheet and cover are attached together to form one combined unit. Process 500 then terminates at end operation 512. If multiple zippers are present, process 500 proceeds NO to fasten first side (and/or end) operation 514, in which one of the sides (and/or ends) comprising fastening or temporary joining mechanisms is fastened, i.e., the fabric sheet and the cover are joined together in a detachable manner on that first side.

Following operation 514, a second side and/or end is joined together 516, in which the fabric sheet and the cover are joined together in a detachable manner on that second side. Process 500 then proceeds to query operation 518, in which it is determined whether there are any other zippers. If NO, the cover and fabric sheet have been secured together in a detachable manner using all available fastening or temporary joining mechanism(s), and process 500 proceeds to end operation 512. If YES, process 500 proceeds to zip remaining side operation 520, in which other fastening or temporary joining mechanism(s) are used to join the cover and fabric sheet on the remaining side and/or end in a detachable manner Process 500 then proceeds to query operation 518 again to determine if there are any remaining sides to fasten together with available fastening or temporary joining mechanism(s). If YES, process 500 proceeds to zip remaining side operation 520 and repeats. If NO, process 500 proceeds to end operation 512. FIG. 5 is merely an example of possible operational characteristics for aligning and joining a cover and detachable fabric sheet in accordance with an embodiment of the present disclosure.

Figure 6:
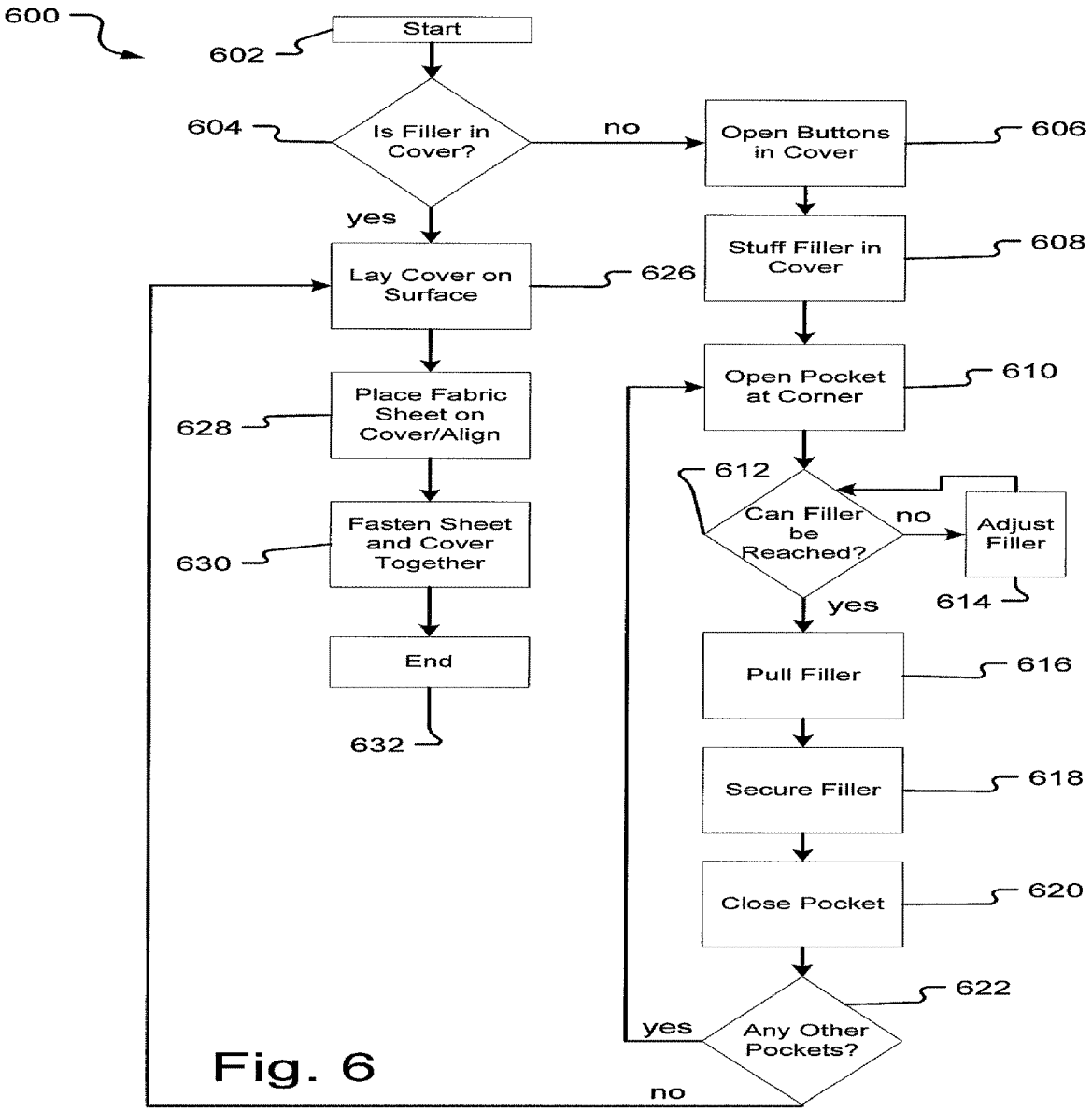
FIG. 6 illustrates s a flow diagram showing the operational characteristics of a process for securing and aligning the cover filler with the cover and for joining the cover and sheet together in accordance with an embodiment of the present disclosure.

In accordance with another embodiment of the present disclosure, FIG. 6 depicts the operational steps 600 for using the combined features of the integrated bedding system to join the detachable fabric sheet to the cover and to align and secure a filler in the cover through the use of pockets at the corners of the cover. Process 602 is initiated and proceeds to query operation 604 in which it is determined if a filler is in the cover. If NO, process 600 proceeds to open operation 606 in which one or more open ends of the cover are exposed by unbuttoning, or otherwise unfastening, such portions of the cover. Once unfastened, process 600 proceeds to fill operation 608 in which the filler is pushed, or "stuffed," into the cover. Fill operation 608 further comprises using an optional alignment/securing mechanism, if available, such as the loop-and-clip system discussed above, to align the filler and secure it in place in the cover. Such alignment/securing mechanism may be located at the open end(s), for example, of the cover. Following such alignment/securing, or if no such alignment/securing system is available or desired, process 600 proceeds to open pocket operation 610 following the inserting of the filler in the cover. Next, query operation 612 determines whether the filler can be reached from the open pocket corner. If NO, the filler is adjusted 614, and process 600 returns to query operation 612 where the determination is repeated. If YES, the filler can now be reached and it is pulled toward the corner of the open pocket in pull operation 616.

Next, one or more aligning/securing mechanisms, such as a loop-and-clip system, are used to attach the filler to the cover in secure filler operation 618. Alternatively, secure filler operation 618 may be an optional step (not shown as optional in FIG. 6). The pocket is then closed 620 by fastening it with the applicable fastening mechanism(s), e.g., buttons and button holes. Upon closing the pocket 620, query operation 622 determines whether other pockets exist that have not yet been opened to adjust and/or align the filler in the cover. If YES, process 600 returns to open pocket operation 610, and process 600 repeats to query operation 624. If NO, process 600 proceeds to operation 626 in which the filled cover is laid on a surface, e.g., flat surface, (this step may also be reached by answering determination operation 604 YES). Next, the detachable fabric sheet is aligned with the cover such that their fastening or temporary joining mechanism(s) are aligned for fastening together in place/align operation 628. Process 600 then proceeds to fasten operation 630 in which the fabric sheet and the cover are joined together to make one combined unit with the fabric sheet suitable for laying on top of a fitted or bottom sheet of a bed, for example. It should be noted that step 630 may involve additional steps (not shown), such as query operation 508 to end operation 512 in FIG. 5. With such additional steps, single or multiple fastening or temporary joining mechanism(s) are accounted for. Process 600 then terminates at end operation 632. FIG. 6 is merely an example of possible operational characteristics in accordance with an embodiment of the present disclosure.

Figure 7:
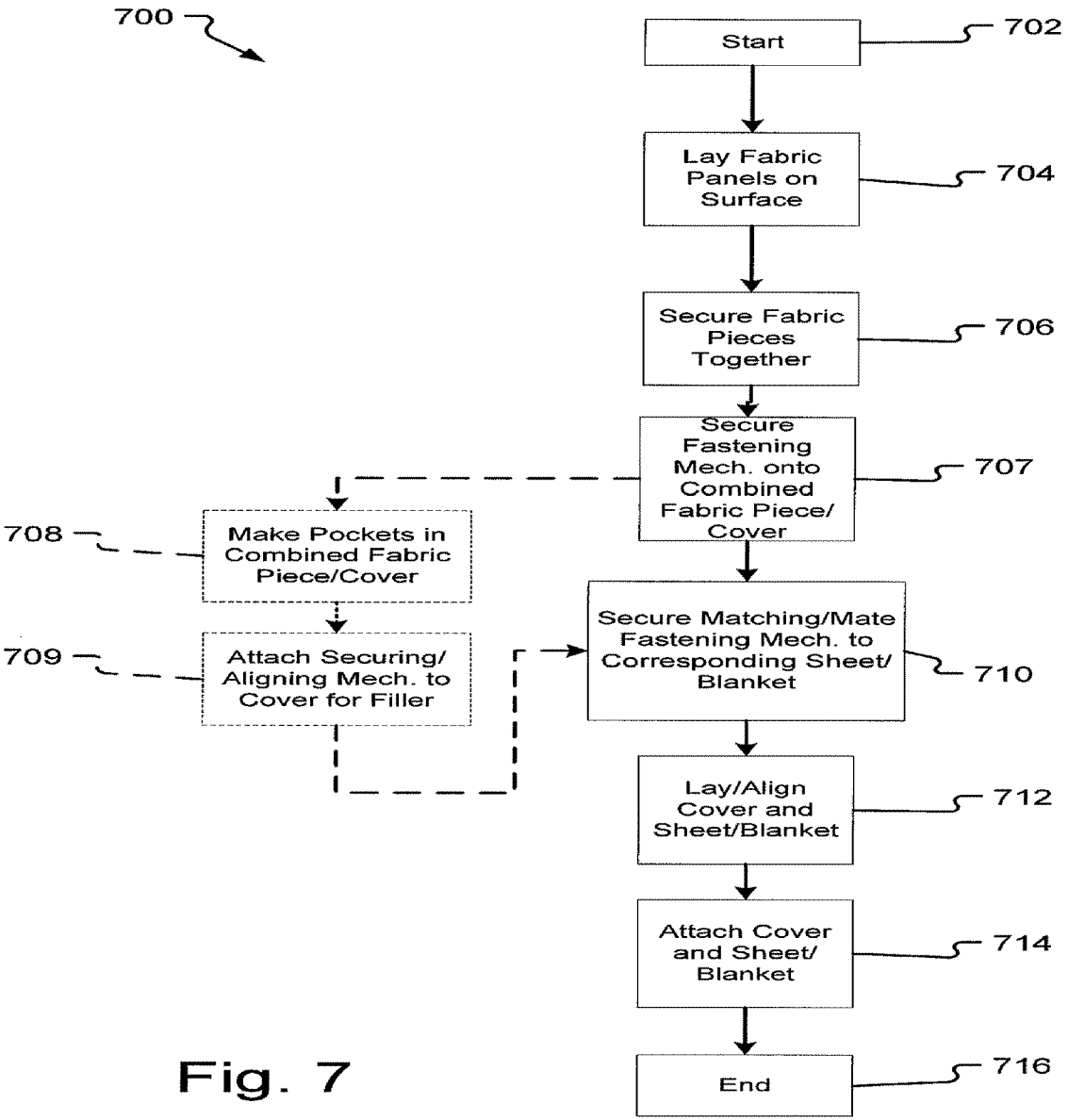
FIG. 7 depicts a flow diagram illustrating the operational characteristics of a process for making a cover with a joining mechanism for detachably joining a fabric sheet to the cover and with an aligning and securing mechanism for the cover filler in accordance with an embodiment of the present disclosure.

While FIGS. 5 and 6 illustrate the operational steps for joining the cover with the detachable fabric sheet through the use of fastening or temporary joining mechanism(s) and for securing the filler of the cover, FIG. 7 depicts the operational steps 700 for making, or manufacturing, an integrated bedding system, in accordance with an embodiment of the present disclosure. Process 700 is initiated with START operation 702 and proceeds to lay operation 704 in which equal sizes of fabric to make a cover housing a cavity are laid on a surface, e.g., flat surface, according to an embodiment of the present disclosure. In another embodiment, different sizes of fabric are used. In yet another embodiment, a single panel, or piece, of fabric is used. Thus, a single panel or multiple panels, or pieces, of fabric may be used in accordance with embodiments of the present disclosure. Where a single panel is used, process 700 skips from operation 704, in which the single panel is laid on a surface, e.g., flat surface, to operation 707 for securing fastening or temporary joining mechanism(s) onto the panel, for example. Where multiple panels are used, these panels, or pieces, are secured to each other in secure operation 706 to envelop the cavity created by joining the side(s) and end(s) of the panels, or pieces, together. In an embodiment, all sides and ends are joined together. In another embodiment, one or more sides or one or more ends is left open so as to create an opening in which a material for filling the cavity housed by the cover may be inserted. In an embodiment, the panels or pieces comprising the cover are sewn together. However, sewing to attach these pieces is only an example of the number of types of securing means that may be used as known by those of ordinary skill in the art.

Next, secure operation 707 secures a first fastening or temporary joining mechanism, e.g., a first zipper mate (or first part), between material of the cover, e.g., in a seam of the cover, or onto the pieces of the fabric on a surface, edge, or side of the cover extending the entire perimeter, or portion thereof, of the cover. Thus, the first fastening or temporary joining mechanism is located at one or more positions on the cover. For example, a first zipper part may be sewn between the two pieces of the fabric on two sides and one end of the cover in accordance with an embodiment of the present disclosure to hide the first zipper part. In another embodiment, a first zipper part or other first fastening or temporary joining mechanism may be secured at a defined distance from the edge of each side and/or end to which the first fastening or temporary joining mechanism is to be attached. In another embodiment, steps 706 and 707 are combined into one step, in which the panels of fabric comprising the cover are secured to each other by securing a first fastening or temporary joining mechanism(s) to the panels. For example, a first zipper, or a portion of a zipper or other fastening mechanism(s), is sewn in-between two panels, or pieces, of fabric, such that the zipper is secured onto the panels and the panels of fabric are joined to each other through the zipper in one step. Process 700 then proceeds. In an aspect of an embodiment, the bottom side and top side of an end of the cover that does not contain a first fastening or temporary joining mechanism may be attached, e.g., sewn, together, to create a closed end, e.g., a standard cover.

In a further embodiment depicted in FIG. 7, pockets are optionally made 708 in the cover by cutting an opening into each desired corner of the cover so as to create a flap through which the cavity of the cover may be accessed. Next, securing/aligning mechanism(s), such as a loop-and-clip system, for example, are attached to the cover at each desired pocket in optional add securing/aligning mechanism (s) operation 709. While these embodiments describe the location of such pockets and loop-and-clip mechanisms as being at the desired "corners" of the cover, it should be understood that these pockets may be created at any location or position on the cover, e.g., on a first or second side, on the top or bottom side, in a middle section, end section, etc. Returning to operation 709 and the exemplary loop-and-clip system and method, a loop or ring or other entity that creates a "void" through which material may be pulled is sewn or otherwise attached/affixed to each desired open corner of the cover. In an aspect of an embodiment, "clips" or other mechanisms for securing the filler to the loop or ring or other entity creating a void are stored with the loop or ring or other entity, while, in another embodiment, clips are simply made available for use with the loop/ring/other entity but are not stored in the cover. In another embodiment discussed, magnets may be sewn into the top and corresponding bottom surfaces of the cover at each desired corner or other location in the cover, e.g., first and second sides, top side, bottom side, so as to allow for the filler to be aligned and pulled to the corner or edge and affixed into place by "clamping" it down with the magnets. In yet another embodiment, pieces of material, e.g., ties or strings, are secured to the cover in one or more locations to align/secure the filler in place inside the cover. While make pockets operation 708 is shown in FIG. 7, it is to be understood that operation 708 is optional. The optional secure/align operation 709 may occur without make pocket operation 708 by reaching into the cover cavity without the use of pockets.

Process 700 then proceeds to match operation 710 in which a second fastening or temporary joining mechanism, e.g., the matching or mate side (for example, corresponding second zipper part) of the first fastening or temporary joining mechanism(s) (for example, first zipper part) for coupling the joining mechanisms together to detachably join the fabric sheet and cover together, is secured to the fabric sheet. In an embodiment, the second fastening or temporary joining mechanism is secured between material of the fabric sheet, e.g., incorporated into a seam of the fabric sheet (or blanket, etc.), or onto the fabric sheet to be attached to the cover. For example, the second fastening or temporary joining mechanism is attached or secured at the defined distance from the edge of the fabric sheet corresponding to the defined distance from the edge of the cover that the first fastening or temporary joining mechanism is attached. The second fastening or temporary joining mechanism is also secured to the fabric sheet at a length and location corresponding to the location or position of the first fastening or temporary joining mechanism on the cover. For example, the corresponding teeth of the zipper, e.g., the second zipper part, are sewn or otherwise attached on the corresponding top or bottom side of a fabric sheet.

The fabric sheet is then placed on top of, or, in another embodiment, below, the cover in lay/align operation 712, and the fabric sheet and the cover are joined to each other in a detachable manner by fastening them one to another in fasten operation 714 using the first and second fastening or temporary joining mechanism Process 700 terminates at end operation 716. FIG. 7 is merely an example of possible operational characteristics in accordance with an embodiment of the present disclosure.

Figure 8:
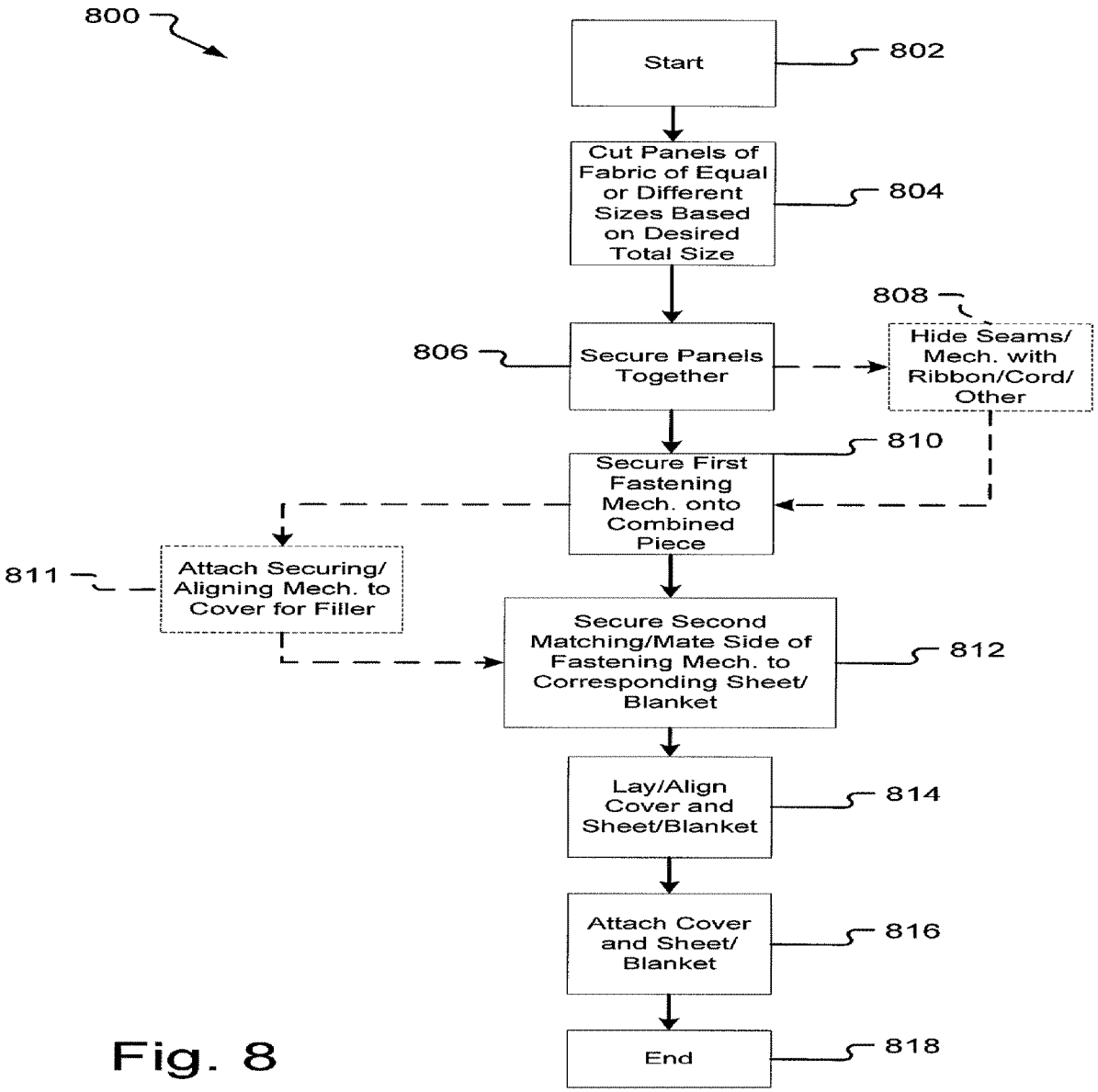
FIG. 8 shows a flow diagram illustrating the operational characteristics for making, or manufacturing, the bedding cover system shown in FIGS. 1-4 in accordance with an embodiment of the present disclosure.

Turning to FIG. 8, process 800 illustrates the operational steps for making, or manufacturing, a bedding cover system in accordance with another embodiment of the present disclosure. Following start operation 802, process 800 proceeds to cut panels of fabric operation 804. In this operation, panels of equal size fabric are cut based on the total size desired for the final bedding system unit, according to an embodiment of the present disclosure. In another embodiment, panels of different sizes are cut from fabric based on the total size desired for the final unit or system. In this operation, the panels may be cut on-site or may come pre-cut from another location for assembly in this manufacturing step. In another embodiment (not shown), a panel, e.g., single panel, of the exact size desired is manufactured without the need for cutting. Instead, this panel is made to the size desired. In such an embodiment, steps 804-808 are not necessary, and process 800 instead proceeds to secure fastening mechanism(s) onto the fabric piece operation 810. Thus, a single panel or multiple panels may be used in accordance with embodiments of the present disclosure.

Following cut fabric operation 804, process 800 proceeds to secure panels together operation 806, in which the panels are attached to each other so as to create a cavity housed by the cover. To create such a cavity, the edges of the panels are typically secured to each other while leaving an open cavity. Such "securing' involves sewing together according to an embodiment of the disclosure. Process 800 then proceeds to secure first fastening or temporary joining mechanism(s) onto the combined fabric piece, or cover, operation 810, in which a first zipper part, or other first fastening/temporary joining mechanism(s) is sewn, or otherwise attached, to the cover. In an embodiment, as discussed, the first fastening/temporary joining mechanism is incorporated, e.g., sewn into, the seam of the cover.

Before proceeding to operation 810, one may proceed to optional operation 808 for hiding, or otherwise disguising, the seam or seams created by joining the fabric panels together for making the cover in secure step 806. For example, the seam or seams may be hidden, or otherwise disguised, by covering them with a ribbon, cord, or other piece of material in hide operation 808, according to an aspect of an embodiment of the present disclosure. In another embodiment, the seam or seams are hidden by turning the fabric over onto itself in such a way as to disguise the combined seam or seams. In yet another embodiment, the fastening or temporary joining mechanism is also hidden, or otherwise disguised, by covering it with a ribbon, cord, or other piece of material.

Following optional hide step 808, process 800 proceeds to secure first fastening and temporary joining mechanism(s) onto the combined piece/cover operation 810. In another embodiment, steps 806 and 810 are combined into one step, in which the panels of fabric are secured to each other by securing fastening or temporary joining mechanism(s) to the panels and using the mechanism to join the panels to each other. For example, a first zipper part, or a portion of a zipper or other first fastening mechanism, is sewn in-between two panels, or pieces, of fabric, such that the first zipper part is secured onto the panels and the panels of fabric are joined to each other through the first zipper part in one step. Process 800 then proceeds.

Next, a second fastening or temporary joining mechanism, i.e., the matching mate, or corresponding part, of the first fastening mechanism, is secured to a fabric sheet, blanket, or other material 812. In an embodiment, the second fastening or temporary joining mechanism is attached to the sheet or other material by sewing the fastening mechanism onto the sheet or other material. In another embodiment, the fastening mechanism is attached by gluing it onto the sheet or other material, in which fast-drying glue is used in an aspect of another embodiment while heat is used in another aspect to secure an adhesive to the sheet or other material. Any number of securing mechanism(s) may be used as known to those of ordinary skill in the art. In other words, while the above discussion describes a "first" and a "second" fastening or temporary joining mechanisms, it is to be understood that any number of fastening or temporary joining mechanisms may be used in accordance with embodiments of the present disclosure.

In an optional step before proceeding to operation 812, process 800 may optionally proceed to attach securing/aligning mechanism(s) to the cover operation 811. In this step, securing/aligning mechanism(s) are attached to the cover for later aligning and/or securing a filler to the cover. In an embodiment, a loop is sewn into each corner, or less than all corners, of the cover. A plastic clip may be temporarily attached to the loop for later use in securing a filler to the cover. In another embodiment, magnets or other fastening devices are sewn into or otherwise secured into the cover to later secure the filler in place. In an aspect of an embodiment, pieces of material, e.g., ties or strings, are secured to each corner or other location in the cover. In another embodiment, pocket(s) may be cut and sewn into the cover so as to provide a way to reach into the cover for straightening and securing of the filler. As discussed above, any number of securing mechanism(s) for securing and aligning the filler may be used without departing from the spirit and scope of the disclosure. Additional steps (not shown) at step 811 may thus may be involved depending on the securing/aligning mechanism(s) chosen for the filler. A combination of securing/aligning mechanism(s) may also be used according to another embodiment of the present disclosure.

Following secure second mechanism operation 812, process 800 then proceeds to lay/align operation 814, in which the cover and sheet or other material are aligned with each other, for example, laid on top of each other, or otherwise brought into contact with each other, so that they may be joined to each other in a detachable manner through the chosen fastening or temporary joining mechanisms in attach cover/sheet operation 816. In another embodiment, the cover and sheet or other material are not attached to each other at the time of making/manufacturing, but, instead, they are left unattached for later joining by the end user. Process 800 then terminates at end operation 818. FIG. 8 is merely an example of possible operational characteristics in accordance with an embodiment of the present disclosure.

According to another embodiment, the bottom side of a cover housing a cavity may be removed, and a first fastening or temporary joining mechanism may then be attached to, e.g., wrapped around, the edges of the side(s) and end(s) of the cover. In an embodiment, the first fastening or temporary joining mechanism is attached to the first side, second side, first end, and second end. In another embodiment, as discussed above, the first fastening or temporary joining mechanism is attached to the first side, second side, and first end; the second end is left without the first fastening or temporary joining mechanism attached thereto. The cover may then be detachably joined to a fabric sheet through coupling the first fastening or temporary joining mechanism located on the edges of the sides of the cover with a corresponding second fastening or temporary joining mechanism located on the fabric sheet. In such an embodiment, the fabric sheet forms the bottom side of the cover and any filling material is then located in the cavity formed between the fabric sheet and the top side and ends of the cover. In other words, the fabric sheet "replaces" the bottom side of the cover. In such an embodiment, the bottom side of the cover may be removed, e.g., cut out, or a cover without a bottom side may be used according to another aspect of an embodiment to allow a fabric sheet to be detachably joined to it through the use of first and second securing mechanisms. In yet another embodiment, where a cover is constructed from attaching pieces/panels of material, only a top side of a cover is used and a fabric sheet is then detachably connected directly to the top side of the cover. In this example, the top side of the cover and the fabric sheet then create the cavity for housing the filler.

Although this disclosure has used language specific to structural features, methodological acts, and materials, it is to be understood that the subject matter defined in the appended claims is not necessarily limited to the specific structure, acts, features, or materials described herein. Rather, the specific structures, features, acts, and/or materials described above are disclosed as example forms of implementing the claims. One skilled in the art will recognize other embodiments or improvements that are within the scope and spirit of the present disclosure. Therefore, the specific structure, acts, or materials are disclosed as exemplary embodiments of implementing the claimed disclosure. The disclosure is defined by the appended claims.

What is claimed is:

1. A bedding cover system, the system comprising:

a bedding cover enveloping a filling material, wherein the bedding cover comprises a first side and an opposing second side, wherein the bedding cover comprises a seam joining the first side and the opposing second side along at least a first edge, a second edge, and a third edge;

a fabric sheet comprising a first side and an opposing second side, the fabric sheet further comprising a first edge, a second edge, a third edge, and a fourth edge;

a first fastening mechanism, wherein the first fastening mechanism is secured at one or more of a first plurality of positions along at least the first edge and the second edge of the opposing second side of the bedding cover; and a second fastening mechanism, wherein the second fastening mechanism is secured at one or more of a second plurality of positions along at least the first edge and the second edge on the first side of the fabric sheet, wherein the second plurality of positions on the fabric sheet correspond to the first plurality of positions on the bedding cover, wherein the second plurality of positions along the first edge extend to at least a first corner on the first side of the fabric sheet, wherein the second plurality of positions along the second edge extend to at least a second corner on the first side of the fabric sheet, and wherein the second fastening mechanism detachably connects to the first fastening mechanism to detachably join the first side of the fabric sheet to the opposing second side of the bedding cover.

2. The bedding cover system of claim 1, wherein the filling material comprises down feathers.

3. The bedding cover system of claim 1, wherein the first fastening mechanism comprises one or more buttons, and the second fastening mechanism comprises one or more slits.

4. The bedding cover system of claim 1, wherein the first fastening mechanism comprises one or more snaps, and the second fastening mechanism comprises one or more snap connectors.

5. The bedding cover system of claim 1, wherein the first fastening mechanism comprises a first portion of a zipper, and the second fastening mechanism comprises a second portion of the zipper.

6. The bedding cover system of claim 1, wherein the second fastening mechanism extends along the first edge, the second edge, and at least a portion of a third edge of the fabric sheet.

7. The bedding cover system of claim 1, wherein the first fastening mechanism extends along the first edge, the second edge, and at least a portion of a third edge of the bedding cover.

8. The bedding cover system of claim 1, wherein the first side of the bedding cover corresponds to a topside of the bedding cover, and wherein the opposing second side of the bedding cover corresponds to an underside of the bedding cover.

9. The bedding cover system of claim 1, wherein the first side of the fabric sheet corresponds to a topside of the fabric sheet, and wherein the opposing second side of the fabric sheet corresponds to an underside of the fabric sheet.

10. A bedding cover system, the system comprising:

a bedding cover enveloping a filling material, wherein the bedding cover comprises a topside and an underside, wherein the bedding cover comprises a seam joining the topside and the underside along at least a first edge, a second edge, and a third edge;

a fabric sheet comprising a topside and an underside, the fabric sheet further comprising a first edge, a second edge, a third edge, and a fourth edge;

a first fastening mechanism, wherein the first fastening mechanism is secured at one or more of a first plurality of positions along at least the first edge and the third edge of the underside of the bedding cover; and a second fastening mechanism, wherein the second fastening mechanism is secured at one or more of a second plurality of positions along at least the first edge and the third edge on the topside of the fabric sheet, wherein the second plurality of positions on the fabric sheet correspond to the first plurality of positions on the bedding cover, wherein the second plurality of positions along the first edge extend to at least a first corner on the topside of the fabric sheet, wherein the second plurality of positions along the third edge extend to at least a second corner on the topside of the fabric sheet, and wherein the second fastening mechanism detachably connects to the first fastening mechanism to detachably join the topside of the fabric sheet to the underside of the bedding cover.

11. The bedding cover system of claim 10, wherein the filling material comprises down feathers.

12. The bedding cover system of claim 10, wherein the first fastening mechanism comprises one or more buttons, and the second fastening mechanism comprises one or more slits.

13. The bedding cover system of claim 10, wherein the first fastening mechanism comprises one or more snaps, and the second fastening mechanism comprises one or more snap connectors.

14. The bedding cover system of claim 10, wherein the first fastening mechanism comprises a first portion of a zipper, and the second fastening mechanism comprises a second portion of the zipper.

15. The bedding cover system of claim 10, wherein the second fastening mechanism extends along the first edge, the second edge, and at least a portion of a third edge of the fabric sheet.

16. The bedding cover system of claim 10, wherein the first fastening mechanism extends along the first edge, the second edge, and at least a portion of a third edge of the bedding cover.

* * * * *